US010377553B1

(12) United States Patent
McCarthy

(10) Patent No.: US 10,377,553 B1
(45) Date of Patent: Aug. 13, 2019

(54) METHOD OF USING MUFFLETOP CAN COOLER

(71) Applicant: James McCarthy, Bayfield, WI (US)

(72) Inventor: James McCarthy, Bayfield, WI (US)

( * ) Notice: Subject to any disclaimer, the term of this patent is extended or adjusted under 35 U.S.C. 154(b) by 380 days.

(21) Appl. No.: 14/999,731

(22) Filed: Jun. 20, 2016

(51) Int. Cl.
*B65D 81/38* (2006.01)
*B65D 17/28* (2006.01)

(52) U.S. Cl.
CPC ..... *B65D 81/3879* (2013.01); *B65D 17/4012* (2018.01); *B65D 2517/0013* (2013.01)

(58) Field of Classification Search
CPC ..... B65D 81/3879; B65D 17/4012; B65D 2517/0013
USPC ..... 53/397, 410, 459; 220/739, 395, 903; 229/89–91, 93; 206/216
See application file for complete search history.

(56) References Cited

U.S. PATENT DOCUMENTS 3,738,529 A * 6/1973 Rose ..... B65D 25/34 215/395
6,604,649 B1 * 8/2003 Campi ..... B65D 81/3886 220/592.17

* cited by examiner

*Primary Examiner* — Hemant Desai
*Assistant Examiner* — Amelia Jae-Ippel Vorce
(74) *Attorney, Agent, or Firm* — Richard C. Emery

(57) ABSTRACT

An improved insulated sleeve for prolonging the period during which a chilled beverage can is able to maintain a cool condition is disclosed. The sleeve is generally cylindrical and made from an insulating material and defines a side wall, a floor and an open end. The sleeve further defines a notch which extends at least horizontally through the floor. In another aspect, the invention discloses a method of using the insulated sleeve.

6 Claims, 4 Drawing Sheets

METHOD OF USING MUFFLETOP CAN COOLER

CROSS REFERENCE TO RELATED APPLICATION

This application claims the benefit of U.S. Provisional Application No. 62/231,280, filed Jun. 29, 2015.

FIELD OF THE INVENTION

The invention relates to an improved insulator used when consuming a cold beverage in a can or other container.

BACKGROUND

Can coolers or can insulators made of foam materials have been developed to surround a refrigerated can while consuming a cold beverage, particularly on a warm day, to extend the time period during which the beverage is kept acceptably cold. Modern beverage cans, such as the type used to contain soda or beer are typically provided with a "pop top" or "pull tab" mechanism which is integrated with the can so when lifted a weakened portion in the top surface of the can top will break, allowing the beverage in the can to be consumed. Because such beverages are carbonated and/or stored under pressure prior to opening, opening such a can is usually loud and sometimes followed by an uncontrolled outburst of liquid. What is clearly needed, therefore, is a way to both at least partially silence the noise and contain the outburst liquid while also providing the function of extending the period the beverage is kept cold.

SUMMARY

In one aspect the invention comprises an insulating sleeve to prolong the period during which a chilled beverage can is able to maintain an acceptably cool condition. The sleeve is formed from an insulating material defining a side wall, a floor and an open end and further defines a notch extending at least horizontally through the floor.

In another aspect the invention comprises a method of using an insulating sleeve. The method includes the steps of procuring an unopened beverage can defining a lower end and an upper end further defining a pull tab mechanism. The can is placed on a surface with the pull tab mechanism aligned and accessible for opening. The sleeve defines a floor which further defines a notch extending at least horizontally through the floor and an open end, so the open end is facing the upper end. Following this step the sleeve is inverted approximately one hundred eighty degrees and the open end of the sleeve is slid over the upper end of the can until the floor substantially contacts the upper end. Next, the sleeve is rotated until the pull tab is aligned with the notch. The pull tab is opened to make the beverage accessible. Following this step, the sleeve is removed from the beverage can. Finally, the sleeve is reversed and the can is placed in the sleeve to expose the opened pull tab to allow consumption of the beverage.

DETAILED DESCRIPTION

The particulars shown herein are by way of example and for purposes of illustrative discussion of the invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

NOMENCLATURE

Figure 1:
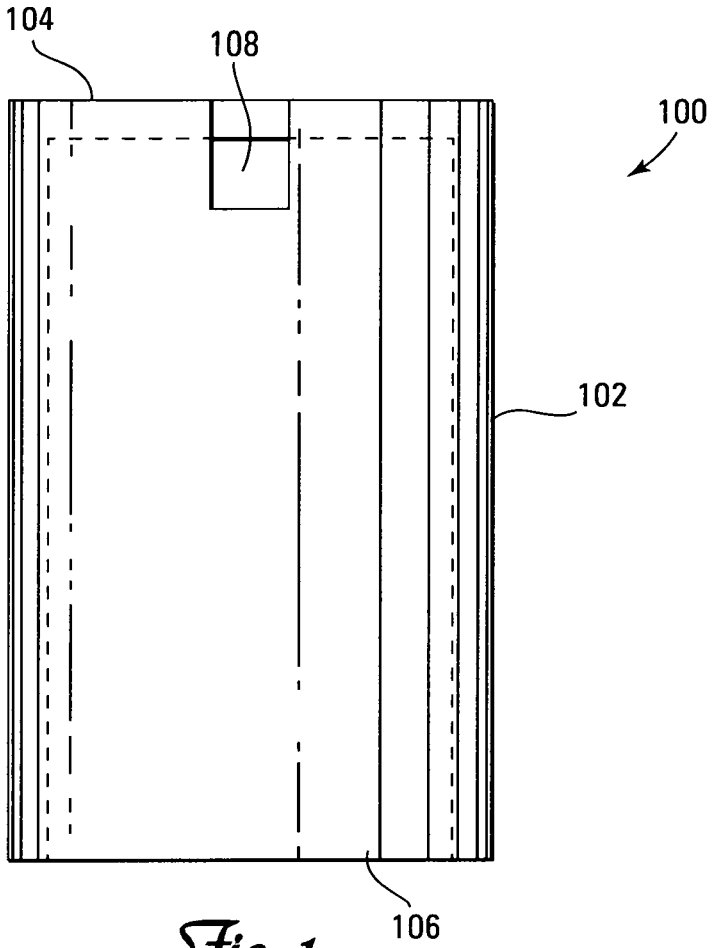
FIG. 1 is a side view of an embodiment of a can insulator of the present invention. Dotted lines are used to indicate the thickness of the material used to construct the insulator.
Figure 2:
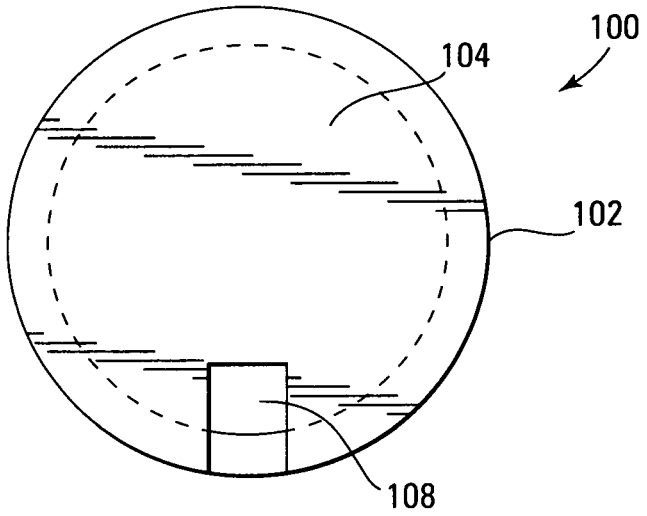
FIG. 2 is a top view of the embodiment of the can insulator shown in FIG. 1. Dotted lines are used to indicate the thickness of the material used to construct the insulator.
Figure 3:
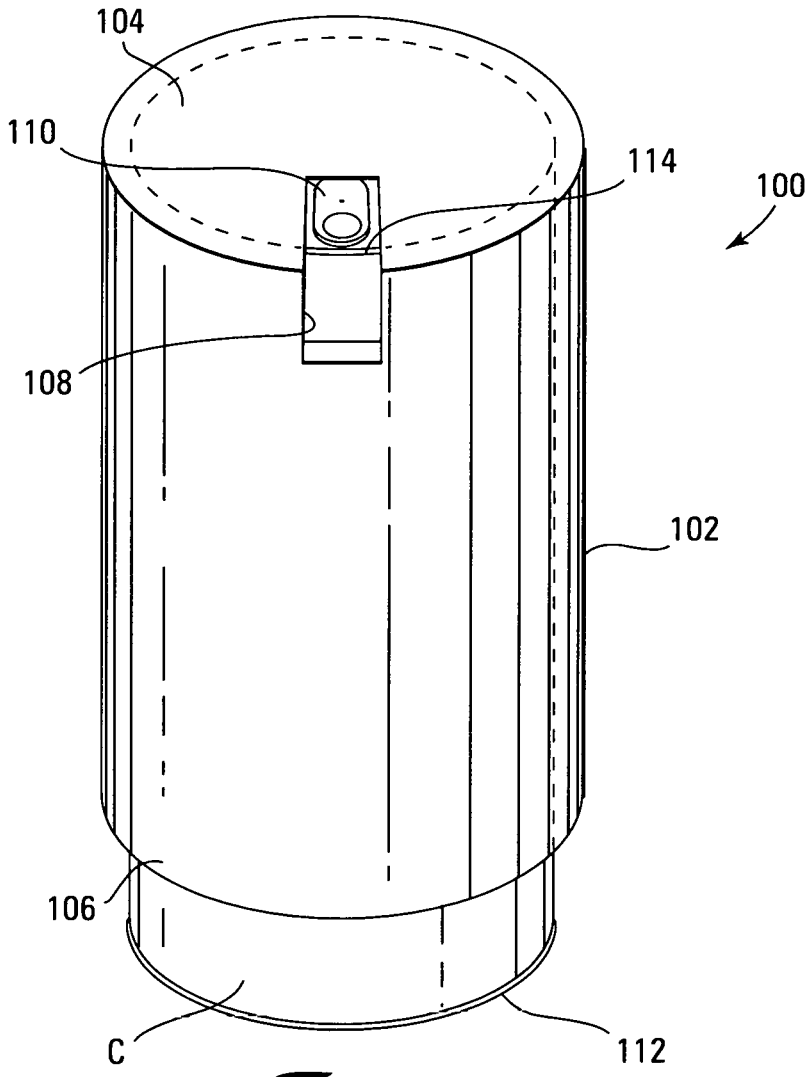
FIG. 3 is a perspective view of the can insulator with a can inside the insulator, prior to opening the can. In this view, the can insulator is in a first position, with the floor of the insulator on top of the can.
Figure 4:
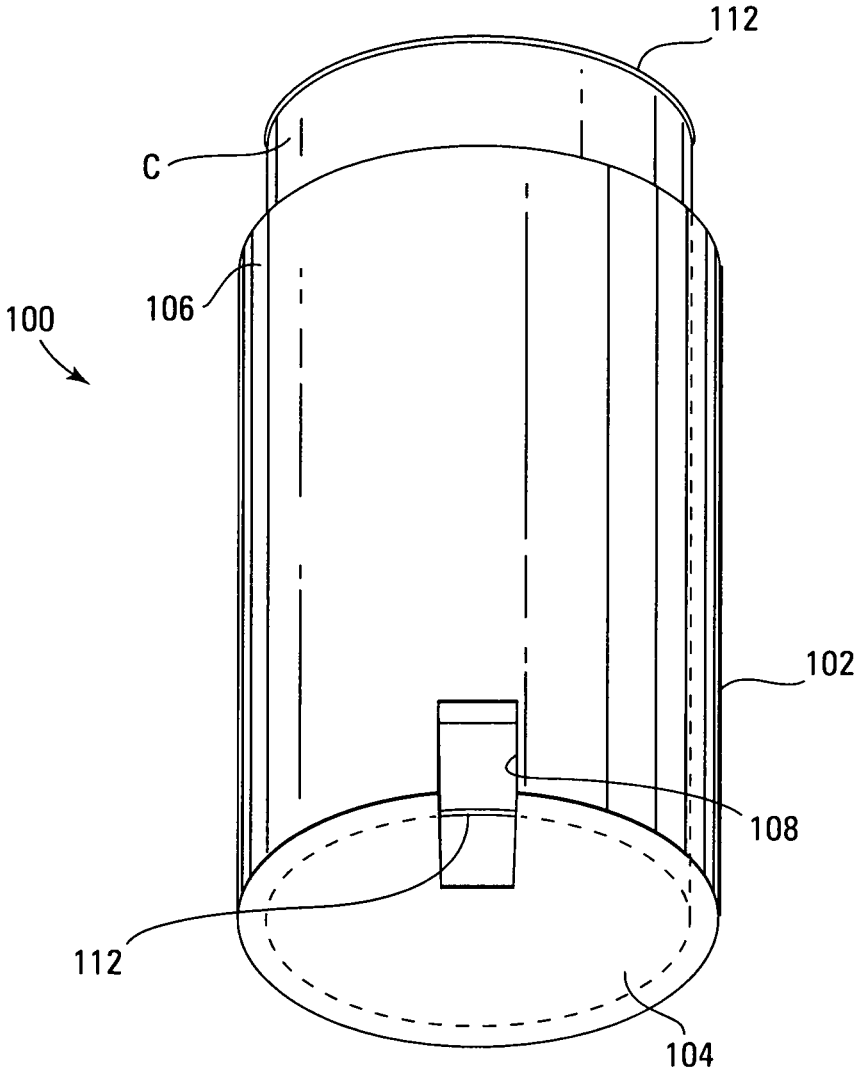
FIG. 4 is a perspective view of the can insulator with a can inside the insulator, following opening the can. In this view, the can insulator is in a second position, reversed from the first position, with the floor of the insulator contacting the bottom of the can and extending through the opening.
Figure 5:
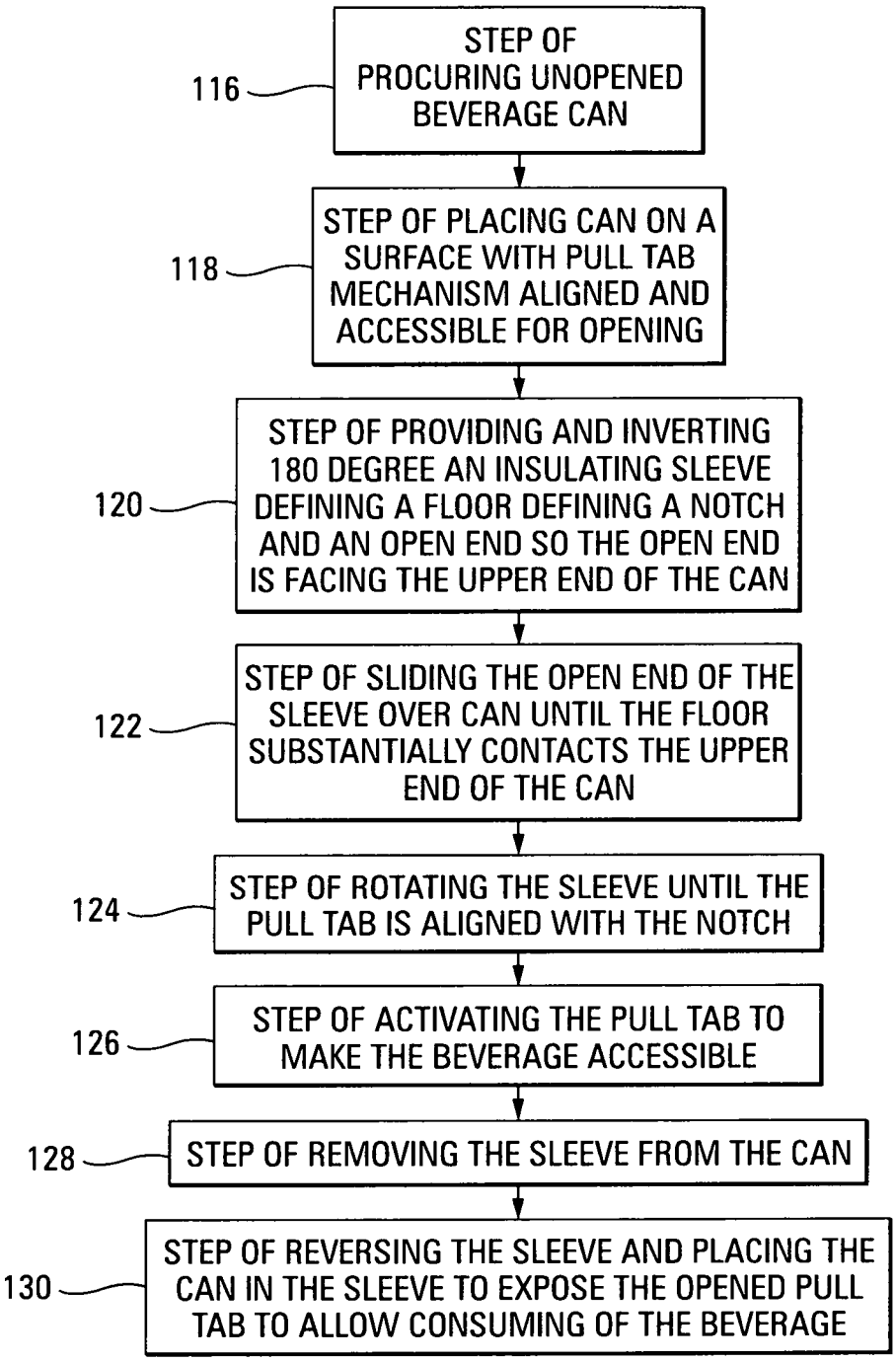
FIG. 5 is a flow chart illustrating the steps involved in using the insulating sleeve of the present claimed invention.

C Beverage Can
100 Insulating Sleeve
102 Side Wall
104 Floor
106 Open End
108 Notch
110 Pull Tab
112 Bottom End of Can
114 Upper End of Can
116 Step of Procuring an Unopened Beverage Can Defining an Upper End and a Bottom End
118 Step of Placing the Can on a Surface with Pull Tab Mechanism Aligned and Accessible for Opening
120 Step of Providing and Inverting Approximately 180 Degrees an Insulating Sleeve Defining a Floor Defining a Notch and an Open End so the Open End is Facing the Upper End of the Can
122 Step of Sliding the Open End of the Sleeve Over the Can Until the Floor Substantially Contacts the Upper End of the Can
124 Step of Rotating the Sleeve Until the Pull Tab is Aligned with the Notch
126 Step of Opening the Pull Tab to Make the Beverage Accessible
128 Step of Removing the Sleeve from the Can
130 Step of Reversing the Sleeve and Placing the Can in the Sleeve to Expose the Opened Pull Tab to Allow Consumption of the Beverage Construction FIG. 1 shows a side view of an embodiment of the insulating sleeve 100 of the present invention. The insulator 100 is preferably cylindrical in shape and defines a side wall 102, floor 104, and an open end 106. A notch 108 extends vertically through the side wall 102 and horizontally through the floor 104, allowing access to the interior (unnumbered) of the insulating sleeve 100. FIG. 2 shows a bottom view of the embodiment of the can insulator 100 with the notch 108 seen extending horizontally extending through the floor 104.

The can insulator 100 can be made of any type of foam rubber (also known as cellular, sponge or expanded rubber) or other insulating material such as plastic foam that is compatible with a food or beverage application. The foam rubber can either be molded as an integral unit or an extruded length of foam tubing can be cut to a length appropriate for a particular beverage can size and a floor member can be attached by means of gluing, sonic welding, etc. The notch 108 can be created by physically cutting (as with a knife or punch), stamping, punching, thermal cutting or as part of the molding process.

It is understood that the can insulator 100 can be sized to accommodate cans of various sizes, thus the scope of the invention should not be considered to be limited to any particular can size. In the United States, this would typically be a 12 or 16 ounce can, but depending on location and other factors could be other sizes.

Method of Use

Using the insulating sleeve 100 of the present invention requires first 116 procuring a beverage can C. The can C is 118 placed on a table or counter top with the upper end 114 (or pull tab) facing upward. Next, an insulating sleeve 100 as described above is 120 is inverted and positioned so the open end 106 is facing the upper end 114 of the can C. In a first position the open end 106 of the can insulator 100 is 122 slid over the upper (or pull tab) end 114 of the can C and slid down until the floor 104 contacts the upper end 114 of the can C. The notch 108 is then 124 rotated and aligned to expose the pull tab 110 through the notch 108. This allows the consumer to place a finger inside the notch 108 to contact and 126 open the pull tab 110, thereby opening the beverage can C. Because the can insulator 100 is in the first position (floor 104 of can C slid down to contact pull tab 110) any noise made by rapidly escaping gas is thereby substantially muffled. Further, any undesired discharge of beverage due to pressure is also at least partly contained.

Following the successful and muffled opening of the can C, the can insulator 100 is 128 removed from the top of the can C and 130 reversed, to define a second position (open end 106 of sleeve 100 facing upward or accessible). The can C is then placed through the open end 106 until the bottom end 112 of the can C reaches the floor 104 of the can cooler 100 and the upper end 114 of the can C is exposed. Because the pull tab 110 mechanism has already been opened and is completely exposed, it is not necessary to reposition the can C for any reason. The consumer is now able to consume the opened beverage.

What is claimed is:

1. A method of using an insulating sleeve, comprising:

(a) procuring an unopened beverage can defining a lower end and an upper end further defining a pull tab mechanism;

(b) placing the can on a surface with the pull tab mechanism aligned and accessible for opening;

(c) providing and inverting approximately one hundred eighty degrees an insulating sleeve made of an insulating material, defining a floor further defining a notch extending at least horizontally through the floor and an open end, so the open end is facing the upper end of the can and further defining a side wall substantially perpendicular with the floor;

(d) sliding the open end of the sleeve over the can until the floor substantially contacts the upper end;

(e) rotating the sleeve until the pull tab is aligned with the notch;

(f) opening the pull tab to make the beverage accessible;

(g) removing the sleeve from the beverage can; and (h) reversing the sleeve and placing the can in the sleeve to expose the opened pull tab to allow consumption of the beverage.

2. The method of claim 1 wherein the notch extends horizontally through the floor and vertically through the side wall.

3. The method of claim 1 wherein the sleeve is substantially cylindrical.

4. The method of claim 1 wherein the insulating material comprises a foam material.

5. The method of claim 4 wherein the foam material comprises foam rubber.

6. The method of claim 4 wherein the foam material comprises plastic foam.

* * * * *